US008795582B2

(12) United States Patent
Cimenti et al.

(10) Patent No.: US 8,795,582 B2
(45) Date of Patent: Aug. 5, 2014

(54) DEVICE FOR DISTRIBUTING A MATERIAL IN A MOLTEN STATE

(75) Inventors: Giovanni Cimenti, Bertrange (LU); Claude Bodeving, Fentange (LU); Claude Meisch, Roeser (LU)

(73) Assignee: TMT-Tapping Measuring Technology SARL, Luxembourg (LU)

( * ) Notice: Subject to any disclaimer, the term of this patent is extended or adjusted under 35 U.S.C. 154(b) by 199 days.

(21) Appl. No.: 13/128,547

(22) PCT Filed: Nov. 3, 2009

(86) PCT No.: PCT/EP2009/064529

§ 371 (c)(1), (2), (4) Date: May 10, 2011

(87) PCT Pub. No.: WO2010/052211

PCT Pub. Date: May 14, 2010

(65) Prior Publication Data

US 2011/0220688 A1 Sep. 15, 2011

(30) Foreign Application Priority Data

Nov. 10, 2008 (LU) ..... 91495

(51) Int. Cl.
*B22D 41/06* (2006.01)

(52) U.S. Cl.
USPC ..... 266/240; 266/236

(58) Field of Classification Search
USPC ..... 266/236, 240
See application file for complete search history.

(56) References Cited

U.S. PATENT DOCUMENTS

| | | | | |
|---|---|---|---|---|
| 1,775,220 | A * | 9/1930 | Aeschbach | 414/423 |
| 3,307,230 | A * | 3/1967 | Goss | 164/449.1 |
| 3,792,850 | A | 2/1974 | Krjukov et al. | |

FOREIGN PATENT DOCUMENTS

| | | | |
|---|---|---|---|
| JP | 54073303 | U | 5/1979 |
| JP | 55106650 | U | 7/1980 |
| JP | 57075399 | U | 5/1982 |
| KR | 20040046395 | | 6/2004 |

OTHER PUBLICATIONS

International Search Report PCT/EP2009/064529; Dated Dec. 16, 2009.

* cited by examiner

*Primary Examiner* — Scott Kastler
(74) *Attorney, Agent, or Firm* — Cantor Colburn LLP

(57) ABSTRACT

The invention relates to a device for distributing a material in a molten state, said device comprising a swinging chute (16) supported so as to be capable of swinging about a substantially horizontal swinging axis (25), and a driving group (40). The latter comprises gear motor group (42), a drum winch (44) driven by the gear motor group (42), and at least one cable segment (50, 50') that can be both wound on or unwound from said drum. One end of the cable segment (46, 50, 50') is attached to the swinging chute (16) at a distance L from the swinging axis (25) thereof so as to apply a swinging momentum to said swinging chute (16).

10 Claims, 4 Drawing Sheets

DEVICE FOR DISTRIBUTING A MATERIAL IN A MOLTEN STATE

TECHNICAL FIELD

The present invention relates to a device for distributing a molten material having a tilting runner supported so as to be capable of tilting about a substantially horizontal tilt axis. Such a device is used in particular for distributing liquid iron flowing a through a casting runner of a casting floor of a blast furnace casting bay to two torpedo cars or two ladles which are awaiting beneath the casting floor.

BACKGROUND

U.S. Pat. No. 3,792,850 describes such a device. The tilting runner comprises a supporting cradle, which is supported with the assistance of two supporting trunnions so as to be capable of tilting about a horizontal tilt axis and a runner element with two opposing discharge spouts which is positioned interchangeably in the supporting cradle. A supporting cradle drive unit comprises a motor reducer unit with a crank. This crank is connected via a connecting rod to a lever arm of the supporting cradle.

Document KR20040046395 discloses a tilting runner in which the motor reducer unit is coupled, without an intermediate connecting rod/crank, to one of the two trunnions of the supporting cradle.

A drawback shared by these two tilt mechanisms with a motor reducer unit is that, given the large weight of the tilting runner, the levels of torque output by the reducer must be relatively high, which entails a large and therefore costly motor reducer unit. One advantage of a drive unit with a motor reducer unit resides in the fact it is possible to provide the reducer with a second input shaft connected to a hand wheel which makes it possible to tilt the tilting runner manually in the event of a problem with the motor of the motor reducer unit or with its power supply. However, this second input shaft entails an additional gear train with a very high transmission ratio to allow the tilting runner to be tilted manually, so still further increasing the cost of the motor reducer unit.

There are also tilting runners which have a supporting cradle drive unit which comprises a hydraulic or pneumatic piston-cylinder unit connected to a lever arm of the supporting cradle. However, a hydraulic piston-cylinder unit of large diameter, which requires elevated flow rates of hydraulic oil under high pressure to function, is inadvisable in the immediate vicinity of large quantities of liquid iron (fire hazard). A pneumatic piston-cylinder unit, on the other hand, has the disadvantage of not permitting reliable adjustment of the angle of inclination of the tilting runner. Furthermore, the solutions with a hydraulic or pneumatic piston-cylinder unit have the disadvantage of not providing the possibility of manually tilting the tilting runner in the event of a problem with the supply of hydraulic or pneumatic fluid.

BRIEF SUMMARY

The invention proposes a device for distributing a molten material having a tilting runner equipped with a simple and inexpensive drive unit which nevertheless ensures safe and reliable tilting of the tilting runner.

The present invention further proposes a device for distributing a molten material comprising in known manner per se: a tilting runner supported so as to be capable of tilting about a substantially horizontal tilt axis; a drive unit having a motor reducer unit and a force transmission means connecting the motor reducer unit to the tilting runner, so as to transmit to the latter a tilt moment about the tilt axis thereof. According to a novel aspect, the force transmission means comprises a drum winch driven by the motor reducer unit and at least one length of cable which winds onto the drum or unwinds from the latter; one end of said length of cable being attached to the tilting runner at a distance L from the tilt axis thereof, so as to be capable of applying the tilt moment to the tilting runner. It will be understood that the force transmission means essentially comprises simple elements, which are mostly commercially available. Furthermore, the torque required at the output of the motor reducer unit to cause the drum winch to operate is relatively low, such that a small and therefore inexpensive motor reducer may be used. Most frequently, the reducer need only comprise a gear train made up of a worm screw and a paired worm wheel and may be self-locking when stationary. It will also be understood that cable transmission allows great freedom with regard to the location of the drive unit, which may for example be positioned on the casting floor, in a cabinet adjacent to the tilting runner, or even beneath the tilting runner. Furthermore, apart from the cables, there is no mechanical connection between the drive unit and the tilting runner, which facilitates assembly and disassembly of the drive unit and/or of the tilting runner.

In a first variant embodiment, the force transmission means comprises a single length of cable which is capable of transmitting to the tilting runner a tilt moment in a first direction to move it from a first position into a second position, when said length of cable is wound onto the drum; and the tilting runner is balanced so as to return from the second position to the first position when the cable is unwound from the drum. In other words, the drive unit serves solely to generate the torque to tilt the tilting runner in one direction. Tilting of the tilting runner in the opposite direction is effected thanks to the force of gravity acting directly on the tilting runner.

In a preferred variant embodiment, the force transmission means comprises a first length of cable and a second length, one end of the first length of cable being attached to the tilting runner so as to be capable of applying to the latter a tilt moment in a first direction, when said first length of cable is wound onto the drum; and one end of the second length of cable being attached to the tilting runner so as to be capable of applying to the latter a tilt moment in a second direction, when said second length of cable is wound onto the drum. In this variant embodiment, the drive unit serves to generate the torque for tilting the tilting runner in two directions. It will be understood that this variant embodiment makes it possible to balance the tilting runner such that it is at equilibrium between a first position, in which it discharges the molten material on the left-hand side, and a second position, in which it discharges the molten material on the right-hand side. Consequently, in this equilibrium position, no forces apply to the drive unit.

The device advantageously comprises a first limit of travel end stop defining a first extreme inclination position for the tilting runner, and a second limit of travel end stop defining a second extreme inclination position for the tilting runner. These limit of travel end stops provide a safety stop for the tilting runner.

In order to prevent a cable from breaking when the tilting runner is stopped in its tilt motion by a limit of travel end stop or by another rigid obstacle, an attachment point is provided on the tilting runner for the cable which is advantageously formed by an attachment system with prestressed springs. While the tension in the cable remains less than the spring prestressing force, the springs do not compress, and the attachment system provides an immobile attachment point for the rope. However, if the tilting runner is stopped in its tilt motion by a limit of travel end stop or another rigid obstacle, the force in the length of cable exceeds the spring prestressing force. The springs then compress and the attachment point yields proportionally to the modulus of the tensile force, so limiting the tension in the cable and avoiding premature breakage thereof.

The tilting runner advantageously comprises two lever arms, the end of the first length of cable being attached to the first lever arm and the end of the second length of cable being attached to the second lever arm. These two lever arms are preferably symmetrical relative to a vertical plane passing through the tilt axis, and each lever arm advantageously bears a cable guide in the shape of an arc of a circle, the centre of curvature of which is located on the tilt axis. Thanks to these two cable guides, the lengthening of one length of cable is substantially equal to the shortening of the other length of cable, which permits straightforward winding and unwinding of the two lengths of cable on a single drum.

A tensioning weight is advantageously associated with each length of cable so as to keep the latter taut around the drum when the length of cable is not transmitting any tensile force.

In a first variant embodiment, the tilting runner comprises a runner element with two opposing discharge spouts which is supported with the assistance of two supporting trunnions so as to be capable of tilting about the horizontal tilt axis.

In a preferred variant embodiment, the tilting runner comprises a supporting cradle, which is supported with the assistance of two supporting trunnions so as to be capable of tilting about the horizontal tilt axis, and a runner element with two opposing discharge spouts which is positioned interchangeably in the supporting cradle. This variant with a supporting cradle allows the runner element to be replaced quickly and easily.

The motor reducer unit and the drum winch are preferably arranged beside the tilting runner and are advantageously separated from the latter by a protective wall.

A preferred embodiment furthermore comprises a limit of travel cam attached to the tilting runner, a device for detecting certain predefined positions of the limit of travel cam and a circuit for stopping the motor reducer unit when such a predefined position is detected.

BRIEF DESCRIPTION OF THE DRAWINGS

Other distinctive features and characteristics of the invention will be revealed by the detailed description of some advantageous embodiments given below by way of example, with reference to the appended drawings, in which.

DETAILED DESCRIPTION

Figure 1:
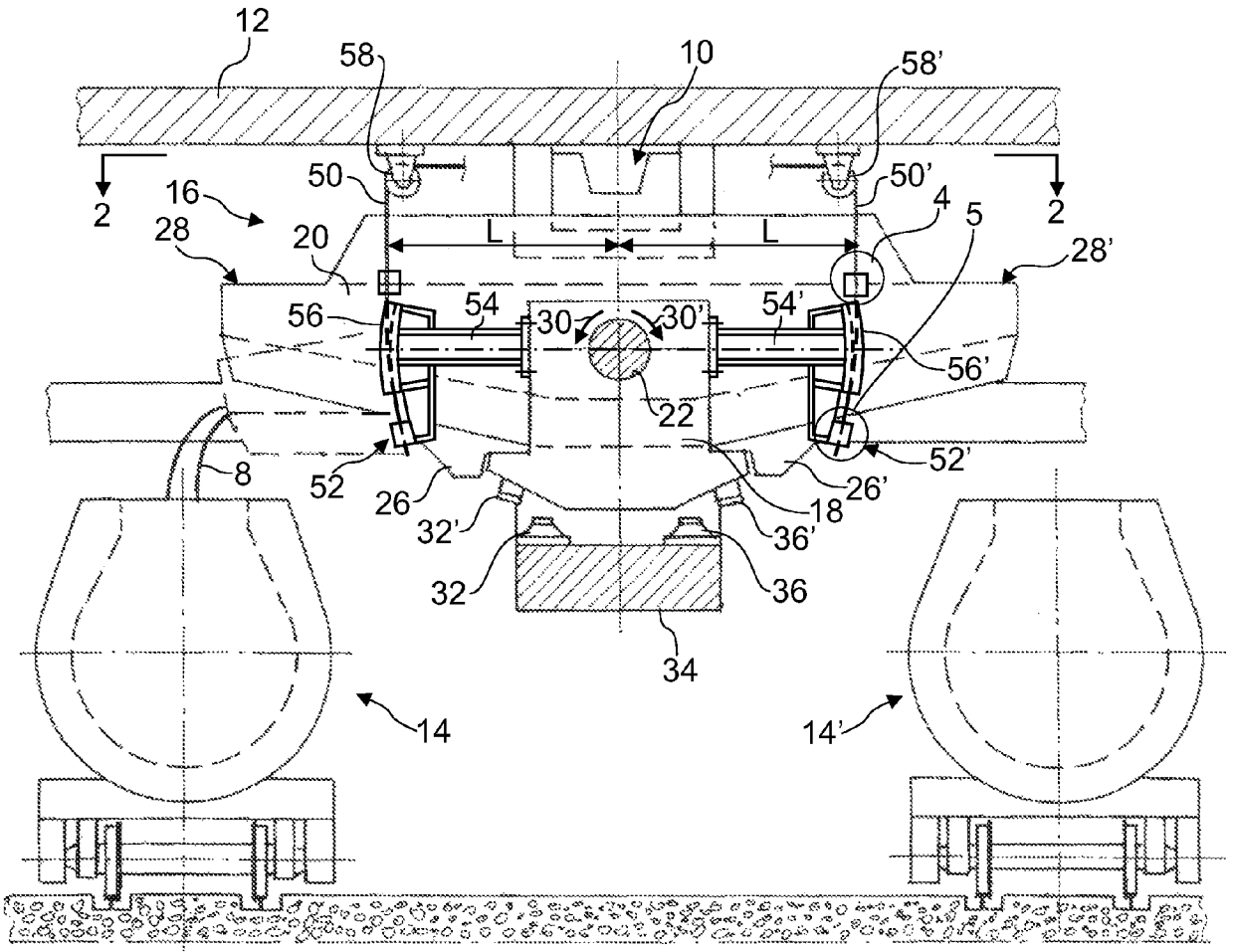
FIG. 1: is a vertical section, along section line 1-1 indicated on FIG. 2, of a device for distributing a molten material according to the invention.

The appended figures show a device according to the present invention, which is used, by way of example, for distributing liquid iron 8 flowing through a casting runner 10 of a casting floor 12 of a blast furnace casting bay to two torpedo cars 14, 14', which are awaiting beneath the casting floor 12. This device comprises a tilting runner, denoted overall by the reference 16, which is advantageously composed of a supporting cradle 18 and an interchangeable runner element 20.

The supporting cradle 18 is equipped with two trunnions 22, 22', which are accommodated in lateral bearings 24, 24', such that the supporting cradle 18 is capable of tilting about a tilt axis 25. The interchangeable runner element 20 forms a discharge spout 28, 28' for the iron at each of the two ends thereof. It is placed from above in the supporting cradle 18 and is equipped with feet 26, 26', which wedge it on the supporting cradle 18 and immobilise it when the latter tilts.

In FIG. 1, the tilting runner is shown in the resting (or waiting) position, in which the runner element 20 is substantially horizontal. It will be noted that the tilting runner 16 assembly is advantageously balanced so as to be at equilibrium in this resting position, i.e. no moment need be applied to keep the runner element 20 substantially horizontal. By applying a tilt moment to the tilting runner 16, it is however possible to cause the supporting cradle 18 to tilt in the direction of the arrow 30 to bring the runner element 20 into an inclined position for discharge into the torpedo car 14 (as suggested by the broken lines in FIG. 1), and in the direction of the arrow 30' to bring the runner element 20 into an inclined position for discharge into the torpedo car 14'.

Reference sign 32 denotes a first end stop borne by a sub-structure 34 so as to cooperate with a first counter end stop 32' on the supporting cradle 18 in order to define an extreme inclination position of the runner element 20, when the supporting cradle 18 is caused to tilt in the direction of the arrow 30. Reference sign 36 denotes a second end stop borne by a sub-structure 34 so as to cooperate with a second counter end stop 36' on the supporting cradle 18 in order to define an extreme inclination position of the runner element 20, when the supporting cradle 18 is caused to tilt in the direction of the arrow 30'.

Figure 2:
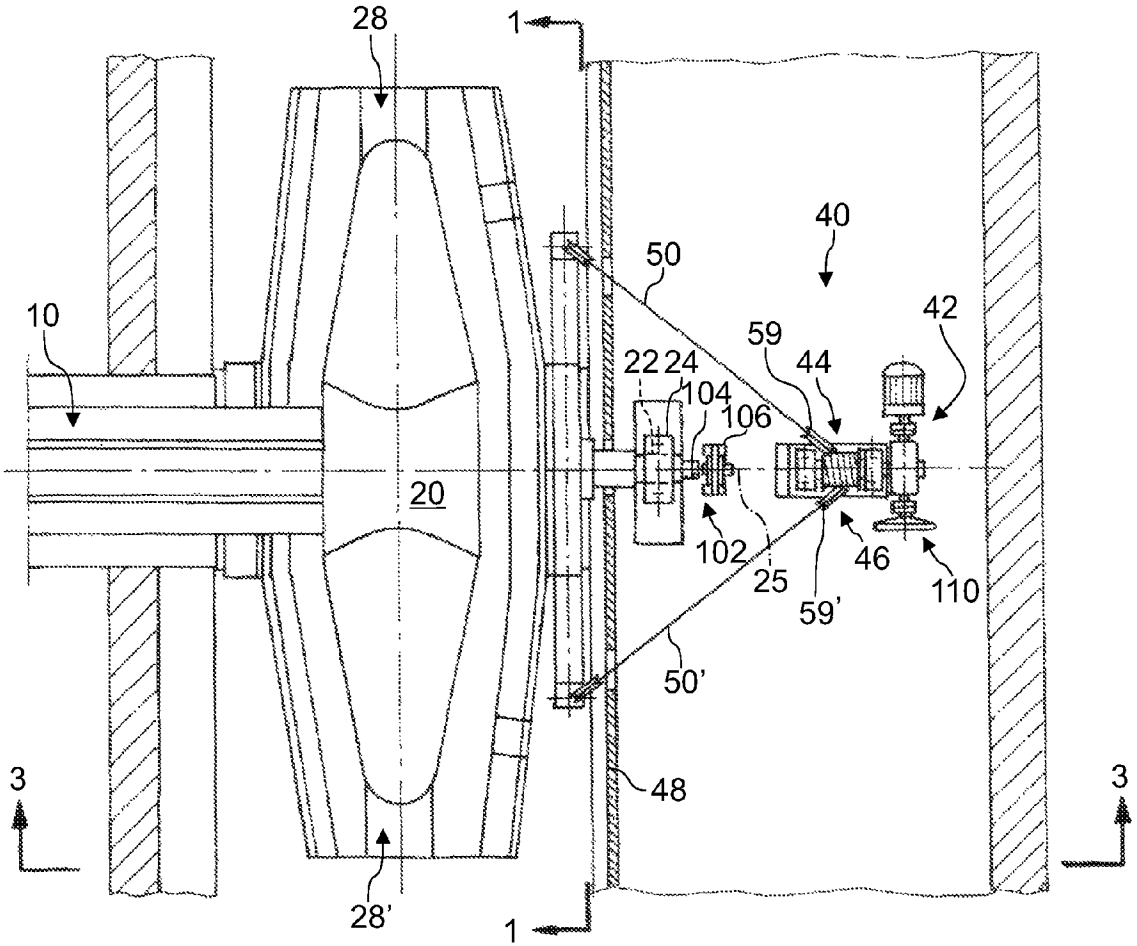
FIG. 2: is a horizontal section along section line 2-2 indicated on FIG. 1.
Figure 3:
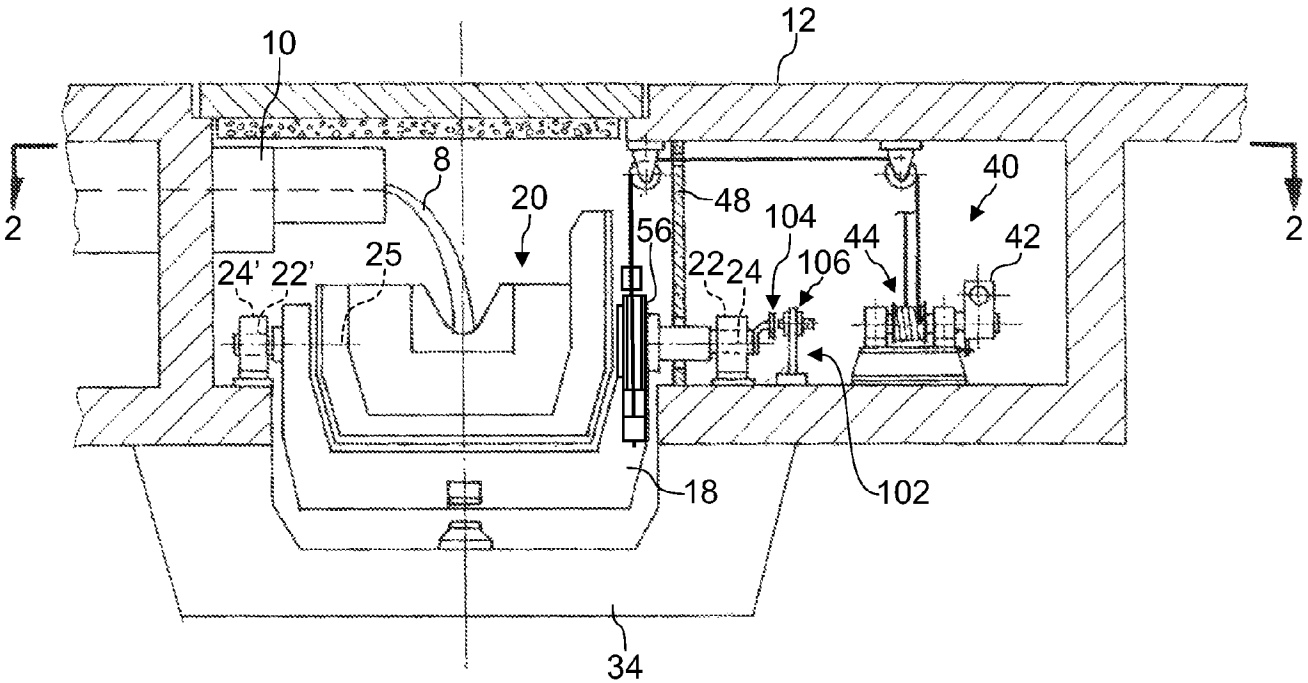
FIG. 3: is a vertical section along section line 3-3 indicated on FIG. 2.

FIGS. 2 and 3 show a particularly advantageous drive unit 40 associated with the tilting runner 16. This drive unit 40 comprises a motor reducer unit 42 which drives a drum winch 44. A cable, denoted overall by the reference sign 46, winds onto and unwinds from the winch, said cable making it possible to apply to the tilting runner 16 a tilt moment about the tilt axis 25 thereof. The drum winch 44 may most often be a standard commercially available model. The motor reducer unit 42 may comprise an electric, hydraulic or pneumatic motor coupled to the reducer. The reducer of the motor reducer unit 42 may be relatively small. Most frequently, it is sufficient for it to comprise a single gear train essentially composed of a worm screw and a paired worm wheel. This worm screw gear train is advantageously dimensioned so as to be self-locking when stationary. It should also be noted that the motor reducer unit 42 and the drum winch 44 are, in the embodiment shown in the figures, arranged beneath the casting floor 12, beside the tilting runner 16, and separated from the latter by a protective wall 48.

In the preferred embodiment shown with the assistance of the figures, the cable 46 comprises a first length of cable 50, equipped with an end 52 attached to the tilting runner 16, at a distance L from the tilt axis 25 thereof, so as to be capable of applying to the latter a tilt moment in the direction of the arrow 30', and a second length of cable 50', equipped with an end 52' attached to the tilting runner 16, at a distance L from the tilt axis 25 thereof, so as to be capable of applying to the latter a tilt moment in the opposite direction indicated by the arrow 30. Between the first length of cable 50 and the second length of cable 50', the cable 46 forms several turns around the drum winch 44. In order to avoid slippage between the drum winch 44 and the cable 46, the latter may be attached to the drum winch 44, such that the length of cable 50 can wind up on one side of this attachment and length of cable 50' can wind up on the other side of this attachment point. Alternatively, each length of cable 50, 50' may of course be attached individually to the drum winch 44.

In FIG. 1, it can be seen that the supporting cradle 18 comprises two lever arms 54, 54' which are symmetrical relative to a vertical plane passing through the tilt axis 25. The first lever arm 54 serves as the attachment point for said first end 52 of the first length of cable 50, and the second lever arm 54' serves as the attachment point for said second end 52' of the second length of cable 50'.

In FIG. 1, it can also be seen that each lever arm 54, 54' bears a cable guide 56, 56' in the shape of an arc of a circle, the centre of curvature of which is located on the tilt axis 25. Reference numerals 58, 58' denote return pulleys arranged above the cable guides 56, 56', symmetrically relative to a vertical plane passing through the tilt axis 25. These return pulleys 58, 58' serve respectively to guide the length of cable 50 and 50', beneath the casting floor 12 to above the drum winch 44. Reference numerals 59, 59' denote return pulleys arranged above the drum winch 44 for guiding the length of cable 50 and 50' respectively onto the drum winch 44.

When the first length of cable 50 winds around the drum winch 44, the second length of cable 50' unwinds from the drum winch 44 and vice versa. Thanks to the two cable guides 56, 56' in the shape of an arc of a circle, the centre of curvature of which is located on the tilt axis 25, the lengthening of a length of cable 50 is substantially equal to the shortening of the other length of cable 50', which permits straightforward winding and unwinding of the two lengths of cable on a single drum.

Figure 5:
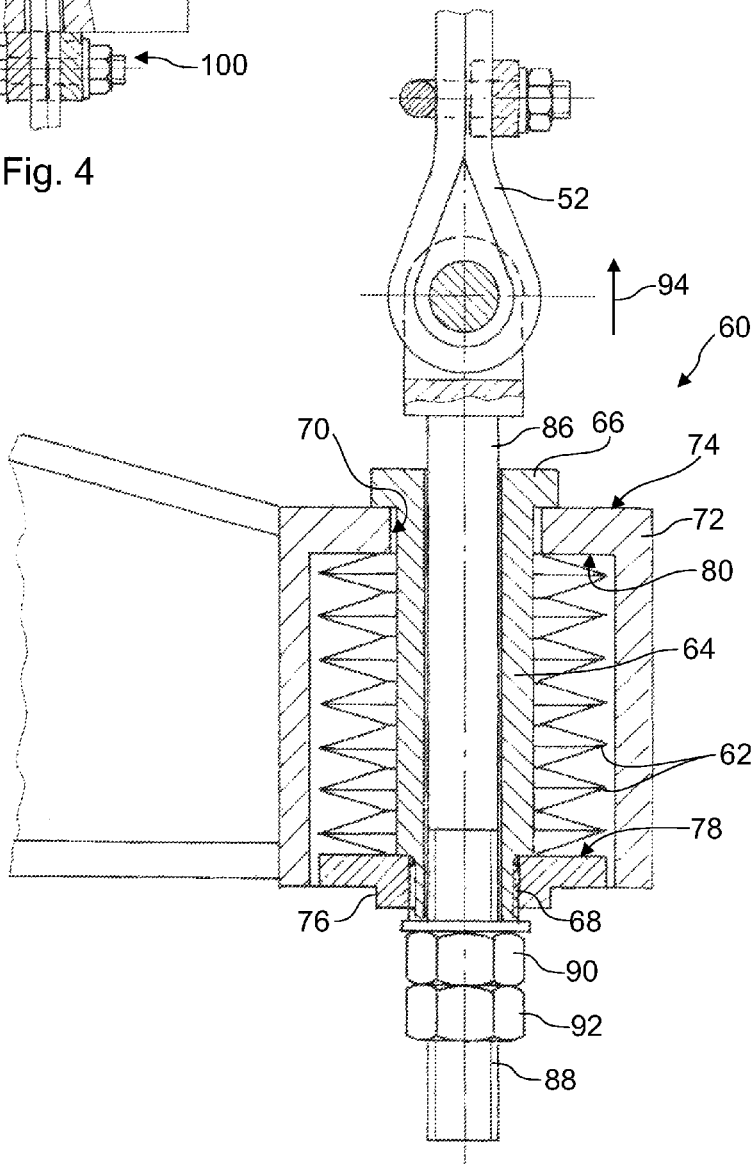
FIG. 5: is a section showing the detail indicated by a circle 5 in FIG. 1.

FIG. 5 shows a preferred attachment of the first end 52 of the length of cable 50 to the lever arm 54 (the attachment of the second end 52' of the length of cable 50' to the lever arm 54' is preferably identical). Reference 60 denotes overall an attachment system with prestressed springs 62, which will now be described in greater detail. This attachment system comprises a tube 64 equipped with a collet 66 at one end and with a thread 68 at the other end. The tube 64 is accommodated in a hole 70 of a base 72 of the lever arm 54, with its collet 66 resting on the outer surface 74 of the base 72. The springs 62, which are advantageously spring washers (Belleville springs), are slipped onto the tube 64, from the opposite end to the hole 70. A plate 76 is screwed onto the thread 68, so as to compress the springs 62 between its inner face 78 and the inner face 80 of the base 72. In this manner, a predefined prestressing force is applied to the springs 62, which force substantially corresponds to the maximum tensile force in the length of cable 50 which is to be anticipated during tilting operation of the tilting runner 16.

The length of cable 50 is attached to an attachment rod 86 which has a threaded end 88 which passes through the tube 64. A tension adjustment nut 90 screwed onto this threaded end 88 forms an adjustable support, with which the attachment rod 86 rests against the lower end of the tube 64. It is accordingly known to tension the length of cable 50 with the assistance of this tension adjustment nut 90. Once the tension in the length of cable 50 has been adjusted, the nut 90 is locked with the assistance of a locknut 92.

While the tension in the length of cable 50 remains less than the spring 62 prestressing force, the springs 62 do not compress, and the tube 64 forms an immobile support for the attachment rod 86. However, if the tilting runner 16 is stopped in its tilt motion by the end stop 32' or by another rigid obstacle, the force in the length of cable 50 exceeds the spring 62 prestressing force, the springs 62 compress, and the tube 64 is drawn by the attachment rod 86 in the direction of the arrow 94, proportionally to the modulus of the tensile force, so limiting the tension in the length of cable 50 and avoiding premature breakage thereof.

Figure 4:
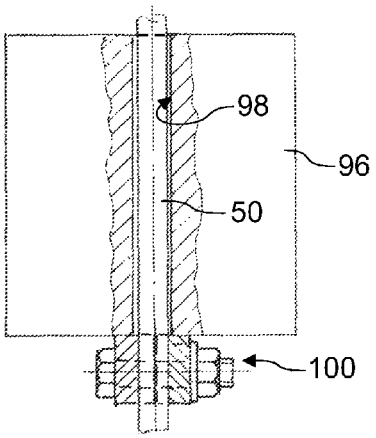
FIG. 4: is a partial section showing the detail indicated by a circle 4 in FIG. 1.

FIG. 4 shows a tensioning weight 96 advantageously associated with the length of cable 50 so as to keep the latter taut around the drum winch 44. This comprises, for example, a lead cylinder provided with a through-channel 98 for the length of cable 50 and which rests on a stop 100, so as to exert tension on the length of cable 50 in the direction of the first end 52 thereof. It should be noted that a similar tensioning weight 96' is advantageously also associated with the length of cable 50'.

On FIGS. 2 and 3, reference numeral 102 denotes overall a limit of travel detection system. This system 102 comprises a limit of travel cam 104 integral with the trunnion 22 and a detection device 106 which makes it possible to detect certain predefined positions of said limit of travel cam, for example with the assistance of mechanical or magnetic contacts or of inductive, capacitive or optical sensors. An electrical system (not shown) may then be used to stop the motor reducer unit when such a predefined position is detected.

On FIG. 3, reference 110 denotes a hand wheel which makes it possible to tilt the tilting runner 16 manually in the event of a problem with the motor of the motor reducer unit 42 or with its power supply. It will be understood that, as a consequence of the large lever arms involved in the transmission of the tilt moment to the tilting runner 16, it is possible to have a relatively small reducer to transmit the manual force to the drum winch 44.

The invention claimed is:

1. A device for distributing a molten material comprising:

a tilting runner supported so as to be capable of tilting about a substantially horizontal tilt axis;

a drive unit comprising a motor reducer unit; and force transmission means connecting said motor reducer unit to the tilting runner, so as to transmit to the latter a tilt moment about the tilt axis thereof;

wherein, said force transmission means comprises a drum winch driven by said motor reducer unit and at least one length of cable which respectively winds onto said drum or unwinds from the latter; one end of the length of cable being attached to said tilting runner at a distance from the tilt axis thereof, so as to be capable of applying said tilt moment to said tilting runner, wherein said force transmission means comprises a first length of cable which respectively winds onto said drum or unwinds from the latter and a second length cable which respectively winds onto said drum or unwinds from the latter, wherein one of the first and second lengths of cable winds onto said drum and the other of the first and second lengths of cable unwinds from said drum; one end of said first length of cable being attached to said tilting runner so as to be capable of applying to the latter a tilt moment in a first direction, and an end of said second length of cable being attached to said tilting runner so as to be capable of applying to the latter a tilt moment in an second direction about the tilt axis thereof.

2. Device according to claim 1, further comprising a first end stop defining a first extreme inclination position for said tilting runner, and a second end stop defining a second extreme inclination position for said tilting runner.

3. Device according to one of claim 2, further comprising:

an attachment system with prestressed springs forming on said tilting runner an attachment point for the end of said first or second length of cable.

4. Device according to claim 1, wherein said tilting runner comprises two lever arms, the end of said first length of cable being attached to said first lever arm and the end of said second length of cable being attached to said second lever arm.

5. Device according to claim 4, wherein said tilting runner comprises:

a runner element with two opposing discharge spouts which is supported with the assistance of two supporting trunnions so as to be capable of tilting about the horizontal tilt axis.

6. Device according to claim 4, wherein said tilting runner comprises:

a supporting cradle supported with the assistance of two supporting trunnions so as to be capable of tilting about the horizontal tilt axis; and a runner element with two opposing discharge spouts, which is positioned interchangeably in said supporting cradle.

7. Device according to claim 4, wherein:

the two lever arms are symmetrical relative to a vertical plane passing through the tilt axis; and each lever arm bears a cable guide in the shape of an arc of a circle, the centre of curvature of which is located on said tilt axis.

8. Device according to claim 1, wherein a tensioning weight associated with said cable so as to keep the latter taut around the drum winch.

9. Device according to claim 1, wherein said motor reducer unit and said drum winch are arranged beside said tilting runner and separated from the latter by a protective wall.

10. Device according to claim 1, further comprising:

a limit of travel cam attached to said tilting runner;

a device for detecting certain predefined positions of said limit of travel cam; and a circuit for stopping said motor reducer unit when such a predefined position is detected.

* * * * *